US007126566B2

(12) United States Patent
Lo

(10) Patent No.: US 7,126,566 B2
(45) Date of Patent: Oct. 24, 2006

(54) DRIVING CIRCUIT AND DRIVING METHOD OF ACTIVE MATRIX ORGANIC ELECTRO-LUMINESCENCE DISPLAY

(75) Inventor: Shin-Tai Lo, Miaoli (TW)

(73) Assignee: Wintek Corporation, Taichung (TW)

( * ) Notice: Subject to any disclaimer, the term of this patent is extended or adjusted under 35 U.S.C. 154(b) by 535 days.

(21) Appl. No.: 10/699,558

(22) Filed: Nov. 1, 2003

(65) Prior Publication Data

US 2005/0093799 A1 May 5, 2005

(51) Int. Cl.
*G09G 3/30* (2006.01)

(52) U.S. Cl. ..... 345/76; 345/82

(58) Field of Classification Search ..... 345/76, 345/77, 80, 82; 257/79; 315/169.3
See application file for complete search history.

(56) References Cited

U.S. PATENT DOCUMENTS 6,452,341 B1 9/2002 Yamauchi et al.
6,693,385 B1 * 2/2004 Koyama ..... 315/169.1
6,870,192 B1 * 3/2005 Yamazaki et al. ..... 257/79
6,876,350 B1 * 4/2005 Koyama ..... 345/92
6,909,242 B1 * 6/2005 Kimura ..... 315/169.3
7,046,240 B1 * 5/2006 Kimura ..... 345/212
2002/0196211 A1 * 12/2002 Yumoto ..... 345/76
2003/0214493 A1 * 11/2003 Akimoto et al. ..... 345/204
2004/0080475 A1 * 4/2004 Yoshida ..... 345/82
2005/0062692 A1 * 3/2005 Lo et al. ..... 345/76
2005/0068274 A1 * 3/2005 Lo ..... 345/82

FOREIGN PATENT DOCUMENTS

JP P2001-343933 A 12/2001

* cited by examiner

*Primary Examiner*—Ricardo Osorio
(74) *Attorney, Agent, or Firm*—Birch, Stewart, Kolasch & Birch, LLP

(57) ABSTRACT

The invention relates to the driving circuit and method of an active matrix organic electro-luminescence display. The writing thin film transistor (TFT) gates of all pixels on the scan line are connected to the scan line. The resetting TFT gates of all pixels on the scan line are connected to the front scan line of the previous row. The switching TFT gates of all pixels within the driving block are connected to the block control line of the driving block. The above block division control and pixel driving circuit design can be used to present gray scale by modulating the display time-ratio. This invention makes use of block separation control and pixel driving circuit design to improve the defect of the timing-inefficiency of the existing digital driving technology tremendously.

2 Claims, 9 Drawing Sheets

DRIVING CIRCUIT AND DRIVING METHOD OF ACTIVE MATRIX ORGANIC ELECTRO-LUMINESCENCE DISPLAY

FIELD OF INVENTION

This invention relates to the driving circuit and driving method of an active matrix organic electro-luminescence display. More particularly, the invention is directed to improve the defect of the timing-inefficiency of the well-known digital driving scheme.

BACKGROUND OF THE INVENTION

Organic electro-luminescence (OEL) displays can be divided into passive matrix type and active matrix type according to the driving method. The so-called active matrix organic light-emitting displays (AMOLED) is to use the thin film transistor (TFT) and the capacitor to store image signals and control the luminance and gray scale of OLED.

Though the manufacturing cost is lower and the technology is common for passive matrix OLED; however, the resolution of the panel can't be enhanced due to its driving method. Therefore, the size of the applied products is limited less than 5 inches, which is confined to low resolution and small size market. The active matrix driving method needs to be applied for finer and larger screens. The so-called active matrix means to store image signals by capacitors. Thus, the original brightness of pixels can be maintained after scanning. In this way, extreme brightness of OLED is not needed, longer operation life is guaranteed and requirements for high resolution can be achieved. Active matrix OLED can be put into practice by combining OLED and TFT technology, which not only meets stricter requirements for smoothness and resolution on the monitor market, but also reveals the superb features of OLED to the full extent.

For driving technology at present, development of AMOLED has two directions; one is the analog method and the other one is the digital way. The reason why digital driving is developed is because TFT elements with excellent features (e.g. threshold voltage and mobility) can't be produced through the current LTPS process. Nevertheless, the stringent demands for LTPS process are not required for digital driving since the image non-uniformity due to the characteristic variation of TFT elements can be compensated merely through a simple 2T1C driving circuit.

As a result, digital driving technology will play a certain role in the development of AMOLED in the future if shortcomings of digital driving method can be corrected efficiently and the integrated driving system can be established.

For the application of digital driving technology at the moment, time-ratio and area-ratio modulation methods are used for gray scale. Take the U.S. Pat. No. 6,452,341 as an example for time-ratio technology. It is based on the separation structure of a writing time 61 and a display time 62 (Program Display Separation) for the realization of digital driving scheme. As FIG. 6 shows, 1~N refers to the scan line and 1~M refers to the display line. For each sub-frame, the writing time 61 is the same, but the display time 62 is T, 2T, 4T, 8T, 16T and 32T in order respectively from SF1 through SF6. Though this approach is easy to implement and the hardware system is less complicated; however, time utility rate is low since the total writing time 61 from sub-frame SF1 through SF6 occupies a certain portion of the frame time.

For instance, refer to the U.S. Pat. No. 6,452,341 as FIG. 7 indicates. The gray scale is achieved by time-ratio modulation and control of the organic electro-luminescence element with a common cathode potential 71 (VH or VL). Thus, when the resolution of the display panel is 176×240 with the scanning frequency of 120 KHz, the writing time 61 of one sub-frame equals to (1/120 K)×240=2 ms. Consequently, the total writing time 61 for the six sub-frames SF1~SF6 will be 12 ms, which occupies 60% of the frame time 20 ms (1 Frame=1/50 sec). As OLED is not illuminated during the writing time 61, the display time utility rate only achieves 40%, which is quite low.

This flaw is acceptable for small size applications; however, this problem needs to be overcome for large size or higher resolution requirement in the future. To promote application of digital driving technology, certain solutions are required to correct the defect of low time utility rate of the conventional driving scheme—program display separation.

One of the solutions is to increase the operating frequency, including scanning frequency and data shifting frequency, etc. This method has no problems for earlier display system that uses external driving IC; however, the solution of built-in driving circuit LTPS-TFT adopted to cope with the development trend of system-on-glass (SOG) cannot easily support very high frequency operation.

Japan Patent No. 2001-343933 discloses an AMOLED driving circuit. FIG. 8 shows the circuit of each pixel. The driving circuit in every pixel includes a Writing TFT 81, an Erase TFT 82, a Driving TFT 83, a Storage Capacitance 84, a Write Scan Line 85, a Erase Scan Line 86, a Data Line 87, a Supply Line 88, a Organic Electro-luminescence Element 89. The gate of Writing TFT 81 in the driving circuit is connected to Write Scan Line 85 and the gate of Erase TFT 82 is connected to Erase Scan Line 86. Gray scale is achieved by modulating display time ratio of the frame in this patent, which improves the flaw of low time utility rate in the driving structure of program display separation. Whereas, two sets of scan drivers are required in addition to the Data Driver 91. One of them is Write Scan Driver 92 connecting to Write Scan Line 85 for data writing. Another is Erase Scan Driver 93 connecting to Erase Scan Line 86 for data erasing as FIG. 9 shows. In this way, an extra set of scan driver is required, which also increases the module cost of monitors.

SUMMARY OF THE INVENTION

The main purpose of this invention is to solve the aforementioned problems existed for a long time. This invention can be applied to LTPS-TFT with AMOLED device to improve the inefficient time utility rate of the original digital driving technology. Meanwhile, a set of scanning device can be shared for data write scan and erase scan through this invention so that the number of elements required for the existing scan circuit technology can be reduced (two sets of scan drivers required, but only one set required for this invention), which benefits reduction of manufacturing cost.

To achieve the said goal, this invention divides the display panel into k driving blocks. The driving circuit of each pixel consists of a Writing TFT, a Switching TFT, a Resetting TFT, a Driving TFT, a Storage Capacitance, an Organic Electro-luminescence Element, a Scan Line, a Data Line, a Supply Line, a Block Control Line and a Start-Erase Line.

The gate of the writing TFT on the scan line is connected to the scan line. The gate of the resetting TFT gates is connected to the front scan line. The gate of switching TFT within the driving block is connected to the block control line of the driving block.

Furthermore, sequences of the operations of a driving circuit can be divided into (1) Data Reset Time, (2) Data Write Time, (3) Data Display Phase 301 and (4) Data Erase Phase 302. The above block division control and pixel driving circuit design can be used to generate the gray scale by modulating the display time-ratio. In every sub-frame, data resetting and data writing are conducted in order from the first to the last scan line. After that, pixels on the scan line are ready to display. Compare with the driving structure of the well-known driving scheme—"Program Display Separation". When the system works at the same scan frequency of 120 KHz, the time utility rate of Program Display Separation only accounts for 40%; however, that of this invention can be up to 78.75%, which improves the defect of timing-inefficiency tremendously.

This invention makes use of block separation control and pixel driving circuit design to put digital driving of AMOELD into practice.

DETAILED DESCRIPTION OF THE EMBODIMENT

Figure 1:
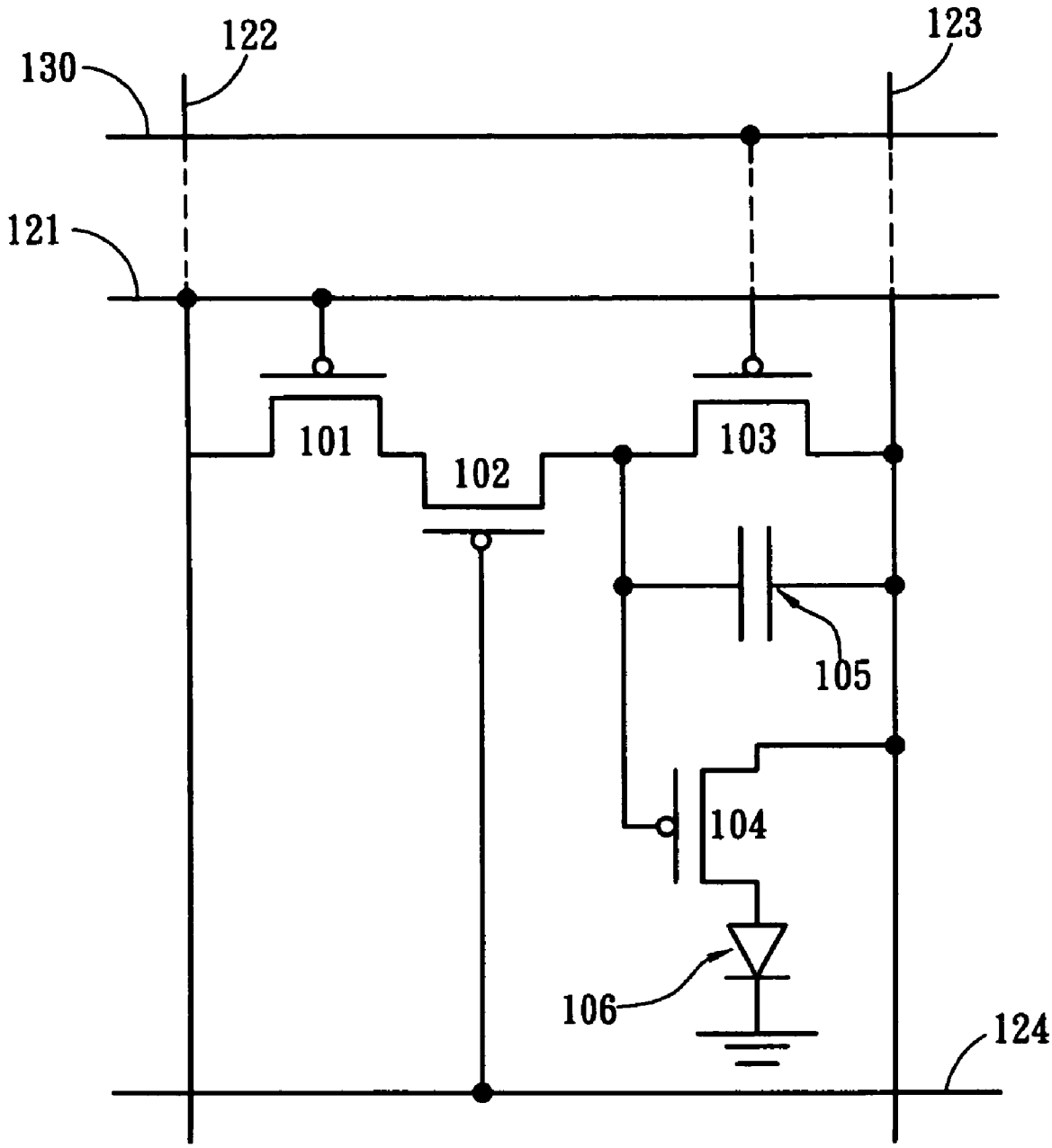
FIG. 1 is a circuit chart in every pixel of the invention.
Figure 2:
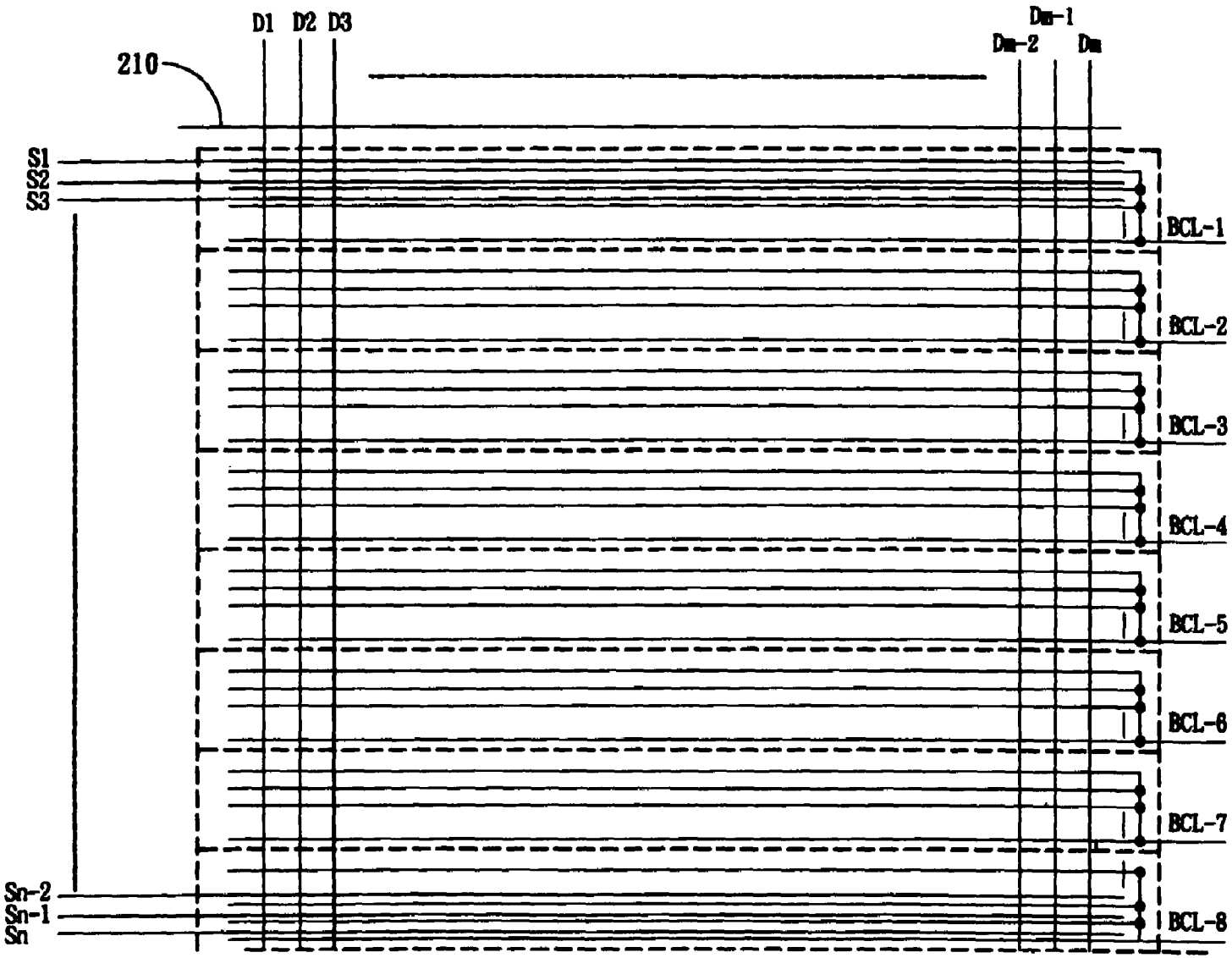
FIG. 2 is part of a circuit chart of the display panel of the invention.

A description of the content and the technology of this invention along with drawings are made in detail as follows:

Refer to FIGS. 1 and 2 at the same time for the circuit chart of every pixel and part of the circuit chart of this invention. The driving circuit of each pixel (shown as FIG. 1) consists of one Writing TFT 101, a Switching TFT 102, a Resetting TFT 103, a Driving TFT 104, a Storage Capacitance 105, a Organic Electro-luminescence Element 106, a Scan Line 121, a front row scan line 130, a Data Line 122, a Supply Line 123, and a Block Control Line 124.

Refer to FIG. 2. First, divide the display panel into k driving blocks (k=8 as an example) (Refer to the description of circuit actuation for actual k value.), which makes the block control line 124 as BCL-1~BCL-8.

The display circuit comprises several scan lines 121 S1~Sn. Gates of Writing TFT 101 of all pixels are connected to Scan Line 121. The drain of Writing TFT 101 and Data Line 122 are connected to each other.

The drain of switching TFT 102 is connected to the source of writing TFT 101 and the gate is connected to the Block Control Line 124.

The drain of resetting TFT 103 is connected to the source of switching TFT 102. The source is connected to supply line 123 and the gate is connected to the front scan line 130. The only exception is the gate of resetting TFT 103 on the first scan line 121 (S1) is connected to Start-Erase Line 210 (See FIG. 2.).

Storage Capacitance 105 has two ends. One of them is connected to supply line 123 and the other is connected to the joint where the source of switching TFT 102 and the drain of resetting TFT 103 meet.

The source of driving TFT 104 is connected to supply line 123 and the gate is connected to the joint where the source of switching TFT 102 and the drain of resetting TFT 103 meet.

The positive electrode of organic electro-luminescence element 106 is connected to the drain of driving TFT 104 and the negative electrode is grounded.

The operation of the circuit for this invention is described as follows. Driving sequences of this invention can be divided into (1) Data Reset Time, (2) Data Write Time, (3) Data Display Phase 301 and (4) Data Erase Phase 302. Explanations are as the following (See FIGS. 1 & 3.):

(1) Data Reset Time:

Resetting TFT 103 of all pixels on scan line 121 is turned on by the control signal of the front scan line 130. Electric charges of storage capacitance 105 will be erased once again to ensure there's no voltage difference between both ends of storage capacitance 105. At the same time, writing TFT 101 is in OFF state and switching TFT 102 is ON. As writing TFT 101 and switching TFT 102 are series connected and writing TFT 101 is OFF, data voltage signals on data line 122 can't be inputted into storage capacitance 105 despite switching TFT 102 is ON.

(2) Data Write Time:

The control signal of the front scan line 130 makes resetting TFT 103 of all pixels on scan line 121 OFF and the control signal of scan line 121 turns on writing TFT 101 of all pixels on scan line 121. As switching TFT 102 of all pixels is ON at this moment, data voltage signals on each data line 122 can be inputted into the corresponding storage capacitance 105.

(3) Data Display Phase 301:

The control signal of the front scan line 130 makes resetting TFT 103 of all pixels on scan line 121 OFF and the control signal of scan line 121 turns off writing TFT 101 of all pixels on scan line 121. Though switching TFT 102 is ON, the storage capacitance 105 of each pixel can hold data voltage signals inputted during data write because the writing TFT 101 is off. Current of the driving TFT 104 of every pixel is determined by the voltage between both ends of storage capacitance 105. When the current of driving TFT 104 passes through the organic electro-luminescence element 106, the corresponding brightness will be generated.

(4) Data Erase Phase 302:

The control signal of block control line 124 makes switching TFT 102 of all pixels within the driving block OFF and the control signal of the front scan line 130 turns on the resetting TFT 103 of all pixels on scan line 121. When the resetting TFT 103 is turned on, electric charges of storage capacitance 105 will be erased, which makes the voltage difference between two ends of storage capacitance 105 become zero. As a result, the current of driving TFT 104 of all pixels on scan line 121 decreases to zero. Consequently, the organic electro-luminescence element 106 on scan line 121 stops illuminating.

As switching TFT 102 is OFF and writing TFT 101 and switching TFT 102 are series connected, the data voltage signal of data line 122 can not be inputted into the storage capacitance 105 even the control signal of the scan line 121 will turn on the writing TFT 101 of all pixels on scan line 121.

Figure 3:
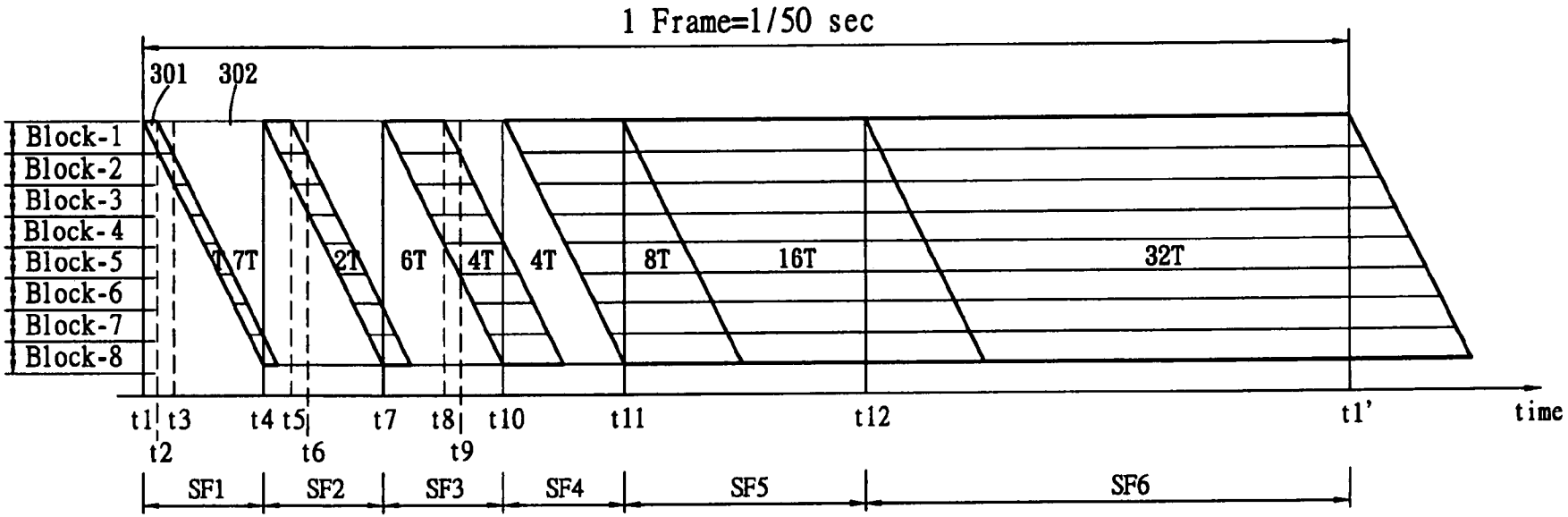
FIG. 3 is a driving time ratio chart of the invention.
Figure 6:
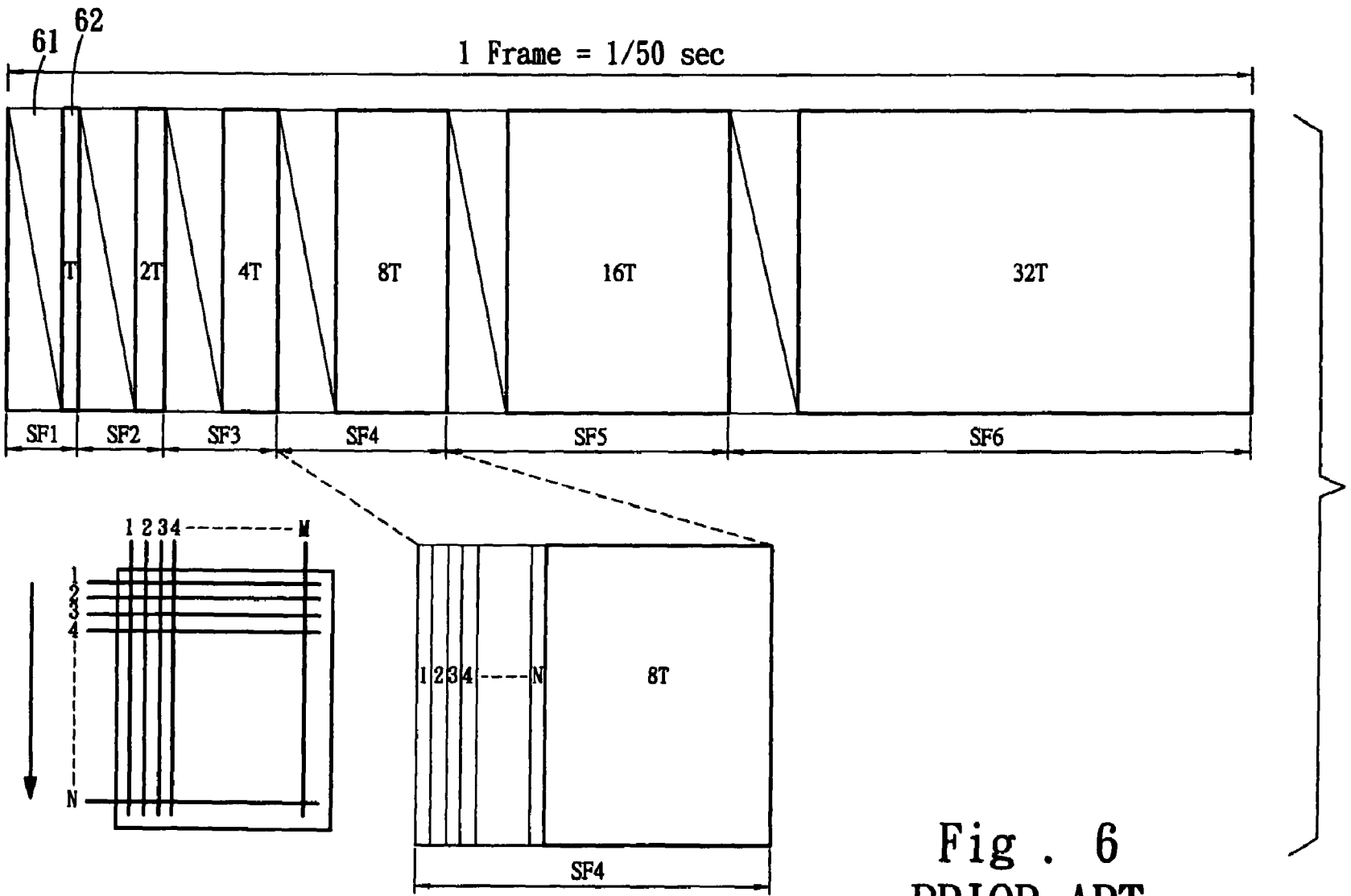
Fig. 6 PRIOR ART
FIG. 6 is a time-ratio chart of the driving scheme—program display separation shown in U.S. Pat. No. 6,452,341.
Figure 7:
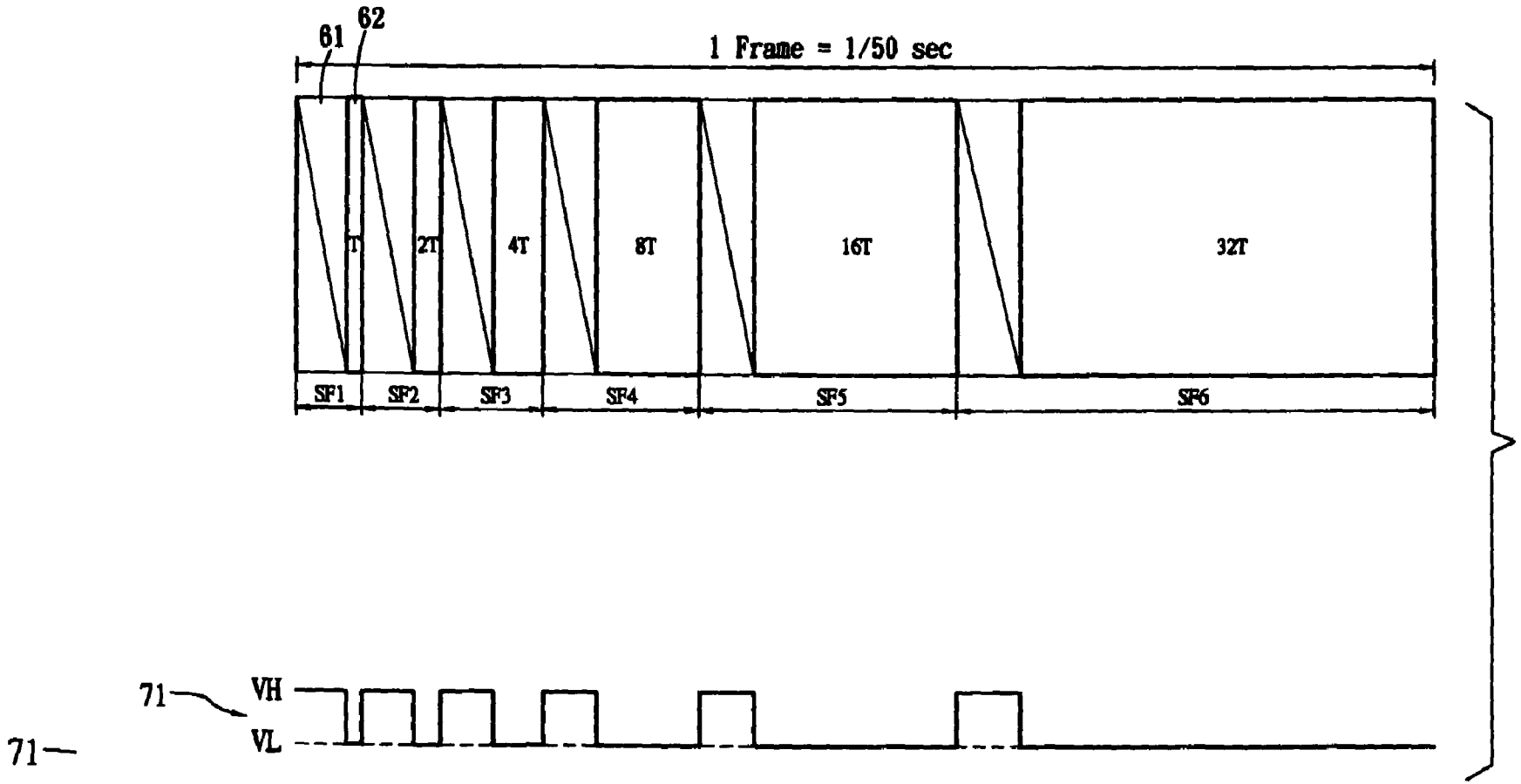
Fig. 7 PRIOR ART
FIG. 7 is a time-ratio with common cathode potential chart of the driving scheme—program display separation shown in U.S. Pat. No. 6,452,341.
Figure 8:
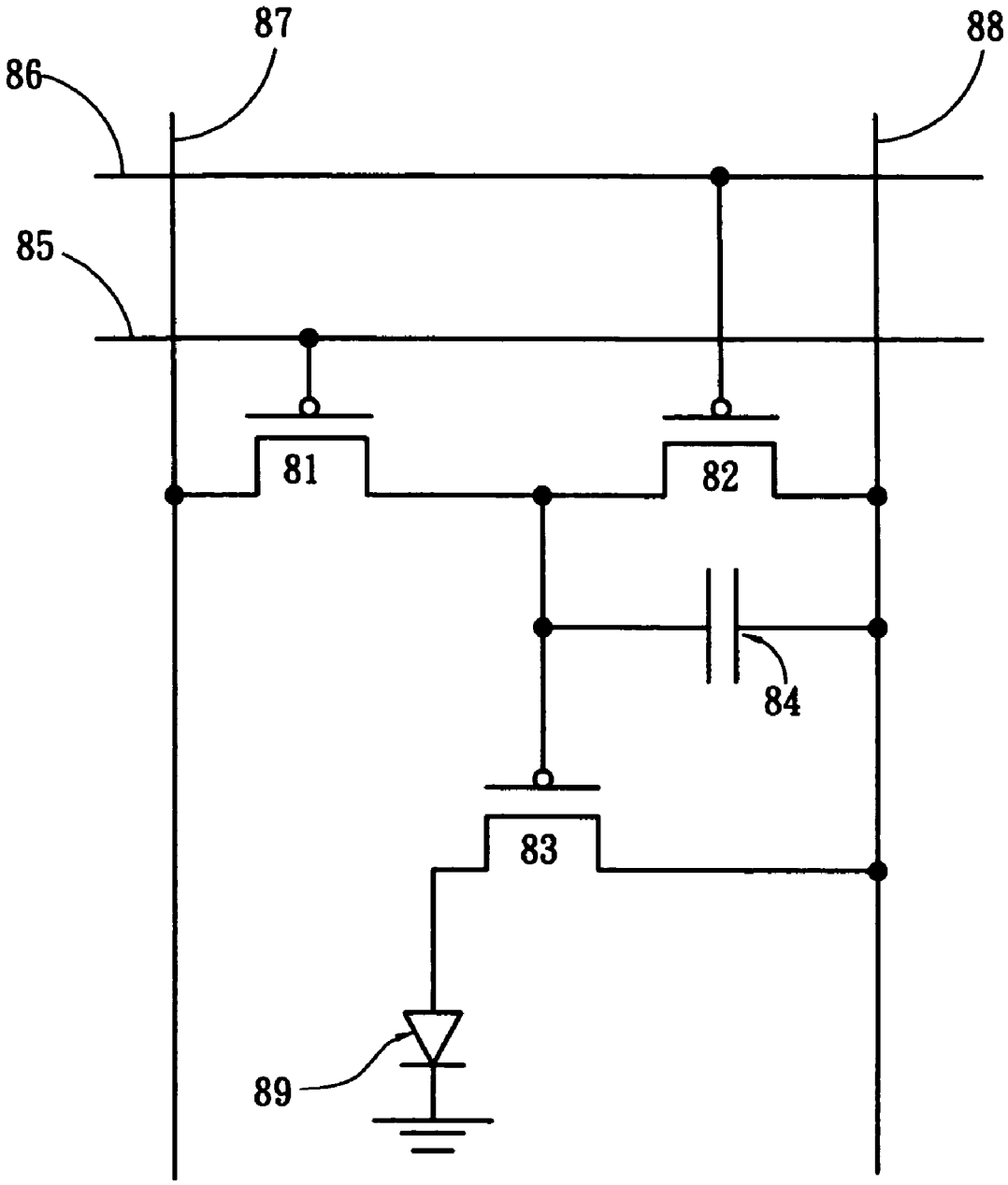
Fig. 8 PRIOR ART
FIG. 8 is a circuit chart in every pixel shown in Japan Patent No. 2001-343933.
Figure 9:
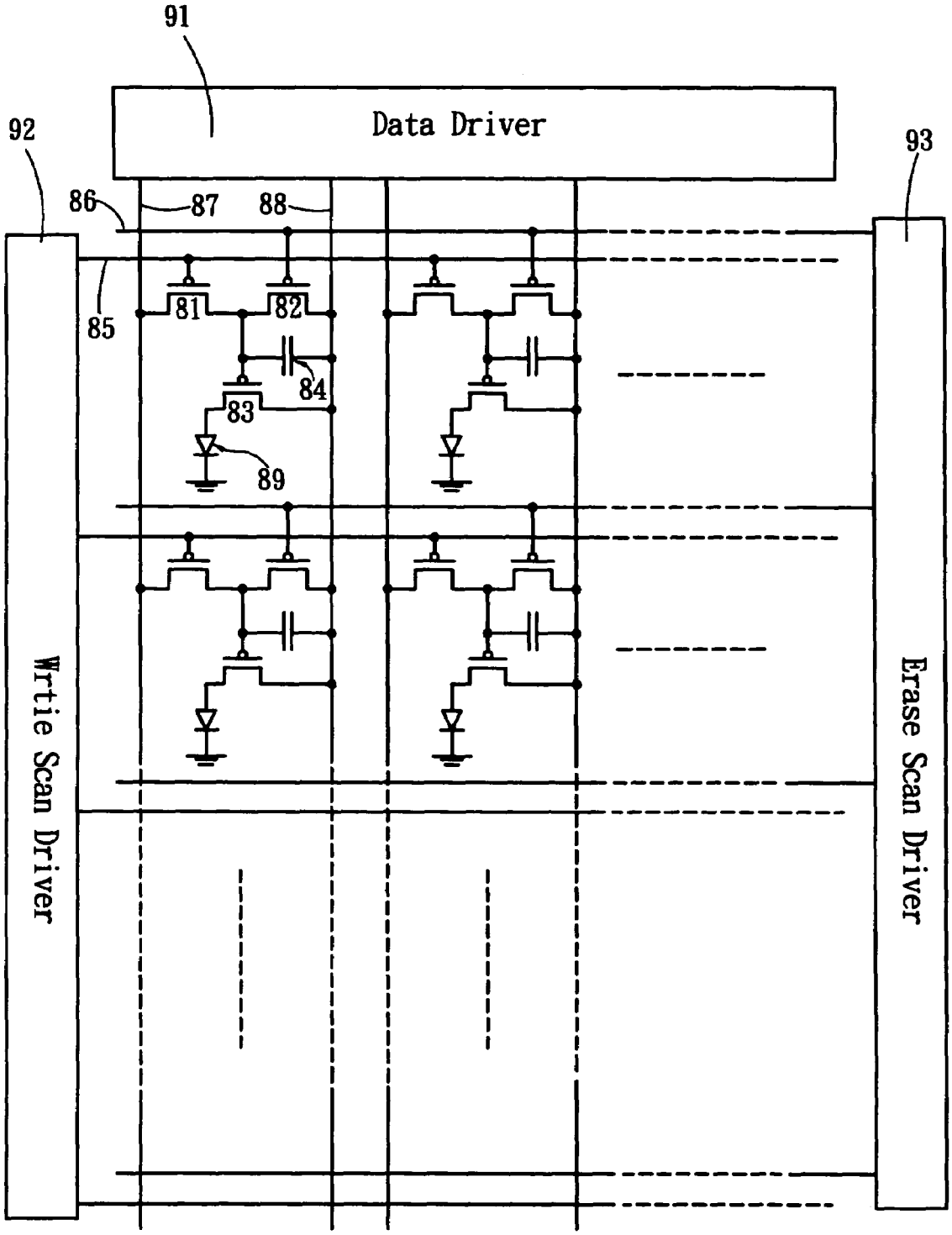
Fig . 9 PRIOR ART
FIG. 9 is a circuit chart of the display panel shown in Japan Pat. No. 2001-343933.

Refer to FIG. 3 for the driving time ratio chart of this invention. As the figure shows, the gray scale is achieved by the adjustment of time-ratio. For every sub-frame from SF1 to SF6, data resetting and data writing are conducted in order from the first to the last scan line 121 in a driving way different from the conventional driving scheme—Program Display Separation shown in FIG. 6. The distinct difference is that the data display phase 301 of the scan line 121 starts immediately after completing data resetting and data writing of pixels in this invention. For different sub-frames, the length of time in data display phase 301 is related to the weighting/importance of the sub-frame.

One thing to be noticed is: the length of time of certain sub-frame data display phase 301 on some scan lines comes to an end; however, certain scan lines 121 do not finish data resetting and data writing of that sub-frame yet due to the limitation of scan frequency. Therefore, the scan line which has finished data display phase 301 has to start data erase phase 302.

Figure 4:
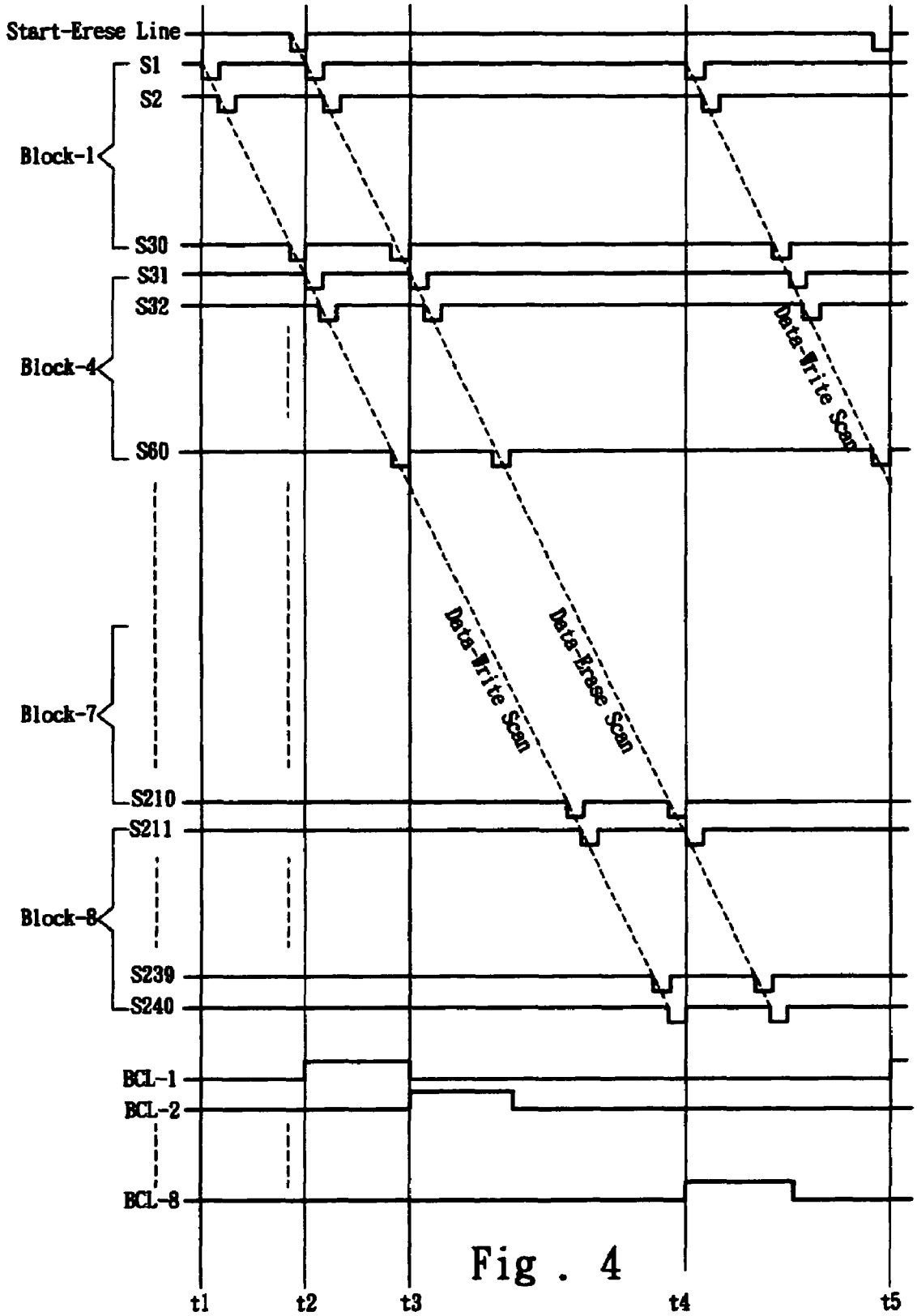
FIG. 4 is the sequential timing chart of control signals for the first sub-frame (SF1) of the invention.

Take the first sub-frame (SF1) in FIG. 3 and the control signal chart of the first sub-frame (SF1) in FIG. 4 as an example (scan line 121 from S1~S240). Data resetting and data writing of the first sub-frame (SF1) will start in order from the first scan line (S1) to the last at the time point of t1. The length of time from t1 to t2 equals to that of data display phase 301 of the first sub-frame (SF1).

At t2, the last scan line 121 (S30) in the first driving block (Block-1) finishes data resetting and data writing for the first sub-frame (SF1). Starting from t2, block control line 124 (BCL-1) sends control signals to turn off the switching TFT 102 of all pixels in every scan line 121 within the first block (Block-1) and erase scan signal is sent from the start-erase line 210 so that data erasing of the first sub-frame (SF1) will be conducted in order from the first scan line (S1) to the last scan line (S30). One point that has to be emphasized is that since erase scan signals of scan line 121 also turn on writing TFT 101 on scan line 121, data voltage signals can be prevented from being inputted into the storage capacitance 105 due to turning off the switching TFT 102 by block control line 124 (BCL-1). When the last scan line (S30) in the first driving block (Block-1) completes data erase phase 302 for the first sub-frame (SF1) at t3, block control line 124 (BCL-1) will shift control signals to block control line 124 (BCL-2).

At t3, control signals of block control line 124 (BCL-2) make the switching TFT 102 of all pixels in every scan line 121 within the second driving block (Block-2) off and erase scan signals transmitted from the last scan line in the first block (Block-1) motivate scan line 121 in the second block (Block-2) to conduct data erase phase 302 of the first sub-frame (SF1). When the last scan line 121 (S60) in the second driving block (Block-2) completes data erase phase 302 of the first sub-frame (SF1), block control line 124 (BCL-2) will shift control signals to block control line 124 (BCL-3).

At t4, the last scan line in the last driving block (Block-8) finishes data resetting and data writing of the first sub-frame (SF1). Starting from t4, data resetting and data writing of the second sub-frame will be conducted in order from the first scan line 121 (S1) to the last scan line 121 (S30). Meanwhile, control signals shifted from the previous block control line 124 (BCL-7) will appear on the last block control line 124 (BCL-8) at t4. Thus, control signals of the last block control line 124 (BCL-8) make the switching TFT 102 of all pixels on every scan line 121 in the last block (Block-8) off. Whereas, erase scan signals transmitted from the last scan line 121 (S210) in the previous block control line 124 (BCL-7) will motivate scan line 121 in the last block (Block-8) to conduct data erase phase 302 of the first sub-frame (SF1) in order.

Based on the explanation above, we may say the quantity k of block control line 124 (i.e. the number of blocks divided) equals to the sum of the length of data display phase 301 (t2−t1) of the first sub-frame and the length of data erase phase 302 (t4−t2) of the first sub-frame divided by the length of data display phase 301 (t2−t1) of the first sub-frame, which is shown as k=[(t4−t1)/(t2−t1)].

Figure 5:
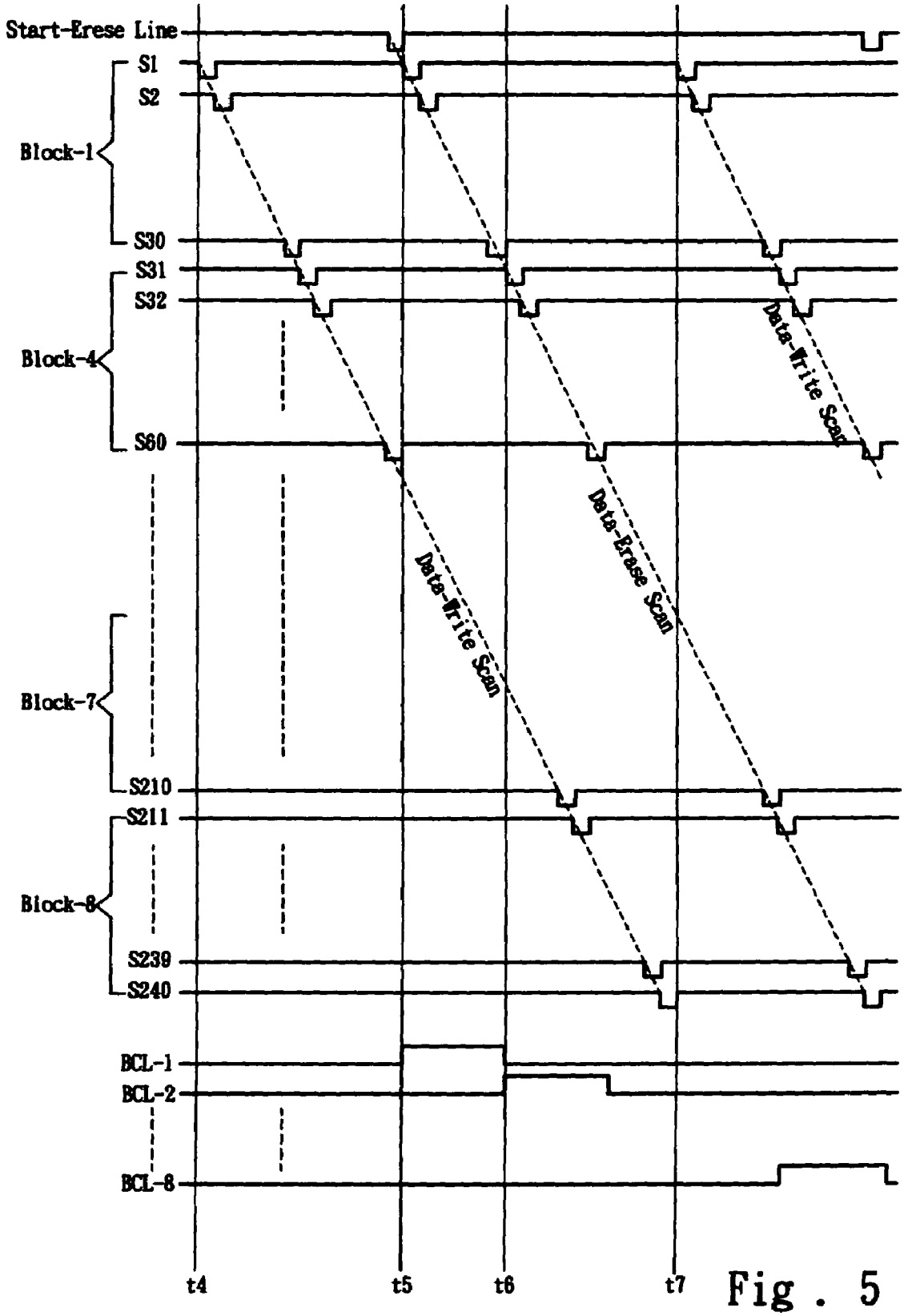
FIG. 5 is the sequential timing chart of control signals for the second sub-frame (SF2) of the invention.

The second sub-frame (SF2) in FIG. 3 works in the same way. Refer to FIG. 5 for the chart of control signal sequences for the second sub-frame (SF2). It is noted that as data display phase 304 of the second sub-frame (SF2) should be two times more than that of the first sub-frame (SF1), length of time between t4 and t5 is twofold of that between t1 and t2. That is to say, when the last scan line 121 (S60) in the second block (Block-2) finishes data resetting and data writing for the second sub-frame (SF2) at t5, block control line 124 (BCL-1) starts to send out control signals making switching TFT 102 of all pixels on each scan line 121 in the first block (Block-1) to off and erase scan signals will be sent in order from Start-Erase Line 210 motivating data erase of the second sub-frame (SF2) from the first scan line 121 (S1) to the last scan line 121 (S30).

Frame time required for driving by this invention is (8T+8T+8T+8T+16T+32T)=80T as shown in FIG. 3. When the frame time is set as 20 ms, which means one T equals to 0.25 ms, and the resolution of the display panel is 176×240, scan frequency will be 1/[(0.25 ms×8)/240]=120 KHz and the display time for 6 sub-frames SF1~SF6 occupies 78.75% [(T+2T+4T+8T+16T+32T)/80T=78.75%] of the frame time. Therefore, the time utility rate will be 78.75%.

Compare with the driving structure of the well-known driving scheme—"Program Display Separation". When the system works at the same scan frequency of 120 KHz, the time utility rate of Program Display Separation only accounts for 40%; however, that of this invention can be up to 78.75%, which improves the defect of timing-inefficiency tremendously.

To sum up, only one set of scanning device is required for data-write scan and data-erase scan while applying this invention, which not only decreases the number of elements needed for a scan circuit in the technology in practice (2 sets of scan drivers required for the prior art, but only 1 set is needed for this invention), but also reduces the manufacturing cost.

In addition, this invention makes use of block separation control and pixel driving circuit design to put digital driving of AMOELD into practice.

What is claimed is:

1. A driving circuit for driving an active matrix organic electro-luminescence display panel which is composed of pixels arranged in columns and rows; columns of pixels are divided as a block controlled by the block control line; the driving circuit of each pixel comprising of:

a writing TFT having a gate connected to a scan line and having a drain connected to a data line;

a switching TFT having a drain connected to the source of the writing TFT and having a gate connected to the block control line;

a resetting TFT having a drain connected to the source of the switching TFT and having a source connected to a supply line and a gate connected to the front scan line, wherein the gate of resetting TFT of all pixels on the first scan line is connected to a Start-Erase Line;

a storage capacitance with one end connected to the supply line and another end connected to the joint where the source of switching TFT meets the drain of resetting TFT;

a driving TFT whose source connected to the supply line. Its gate, the same as one end of storage capacitance is connected to the joint where the source of switching TFT and the drain of resetting TFT meet;

a organic electro-luminescence element with the positive electrode connected to the drain of the driving TFT and the negative electrode grounded.

2. The driving circuit of a first said active matrix organic electro-luminescence display of claim 1, the number of block control lines is determined by the addition of the length of data display phase of the first sub-frame and the length of data erase phase of the first sub-frame, which is divided by the data display phase of the first sub-frame.

* * * * *